US005081718A

United States Patent [19]

Carman et al.

[11] Patent Number: 5,081,718

[45] Date of Patent: Jan. 21, 1992

[54] PANTS TYPE GARMENT HAVING A SEAMLESS CROTCH

[75] Inventors: David C. Carman, Jackson; Frederick E. Liu; Anthony J. DeRosa, both of Wilson; Margaret Murphy, Jackson, all of Wyo.

[73] Assignee: Life-Link International, Inc., Jackson, Wyo.

[21] Appl. No.: 546,528

[22] Filed: Jun. 29, 1990

[51] Int. Cl.[5] ..... A41D 1/06; A41D 13/02

[52] U.S. Cl. ..... 2/227; 2/82; 2/79; 2/243 R; 2/243 B

[58] Field of Search ..... 2/227, 79, 82, 243 R, 2/243 B

[56] References Cited

U.S. PATENT DOCUMENTS 1,488,536 4/1924 Fry ..... 2/227

4,117,609 10/1978 Helt ..... 2/227

4,912,860 4/1990 Keller ..... 2/227

*Primary Examiner*—Werner H. Schroeder

*Assistant Examiner*—Gloria Hale

*Attorney, Agent, or Firm*—Andrew D. Maslow

[57] ABSTRACT

A pants type garment is provided with a leg portion made from a substantially unitary stretchable piece of material which is symmetric about a center fold.

Prior to being formed into the leg portion, said unitary piece of material defines a pattern containing a first V-shaped recessed cut and a second V-shaped recessed cut about the midpoint of the pattern where the crotch portion is to be located.

The crotch is at the center fold of the pattern piece between the two V-shaped recessed cuts.

The substantially rectangular upper portion is attached to the leg portion by a seam which runs along the first and second sides of the V-shaped recessed cuts.

9 Claims, 2 Drawing Sheets

FIG. 1
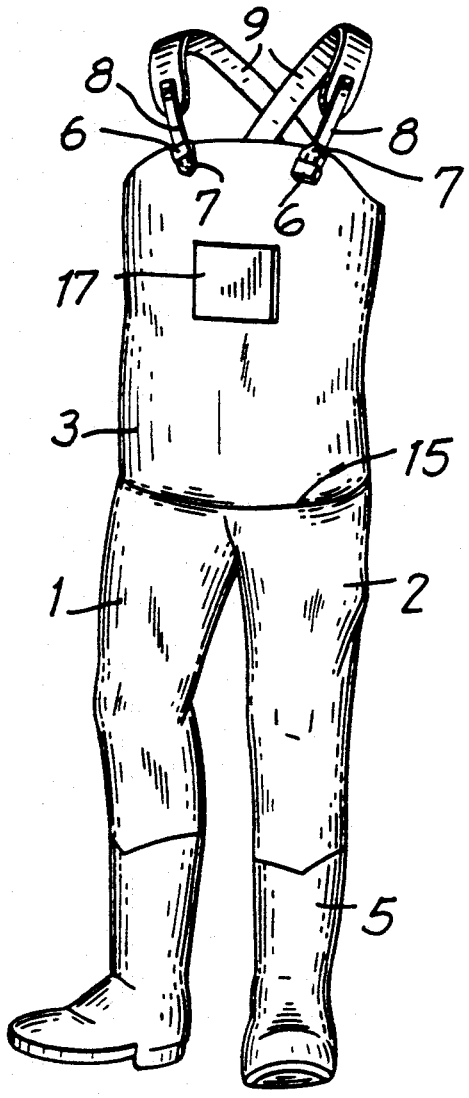
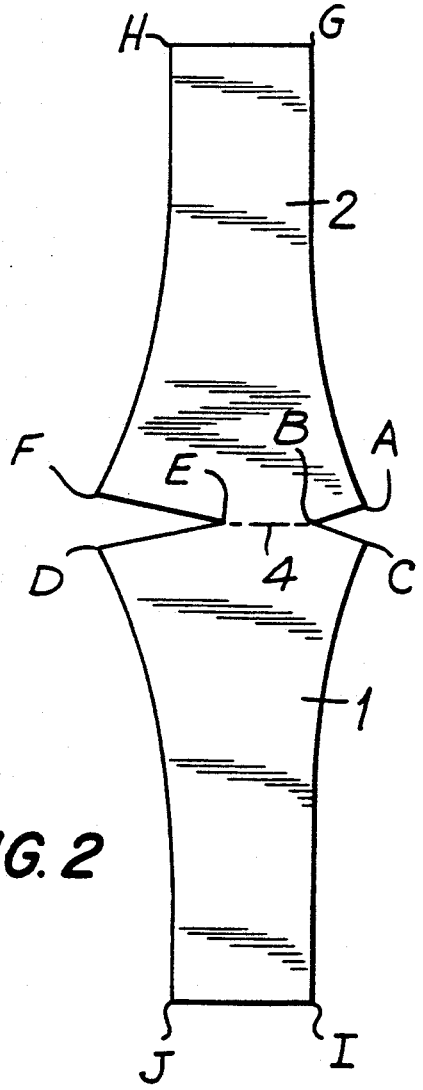
FIG. 2
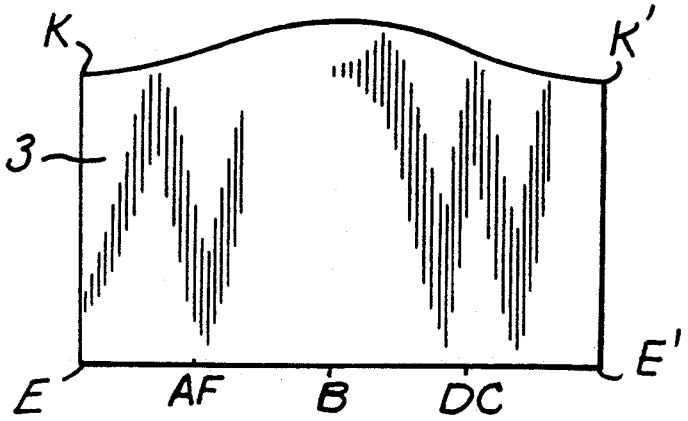
FIG. 3

FIG. 4
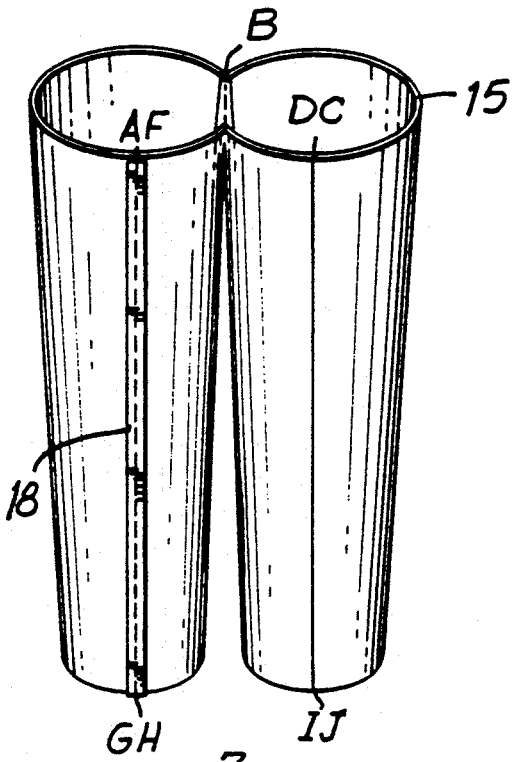
FIG. 5
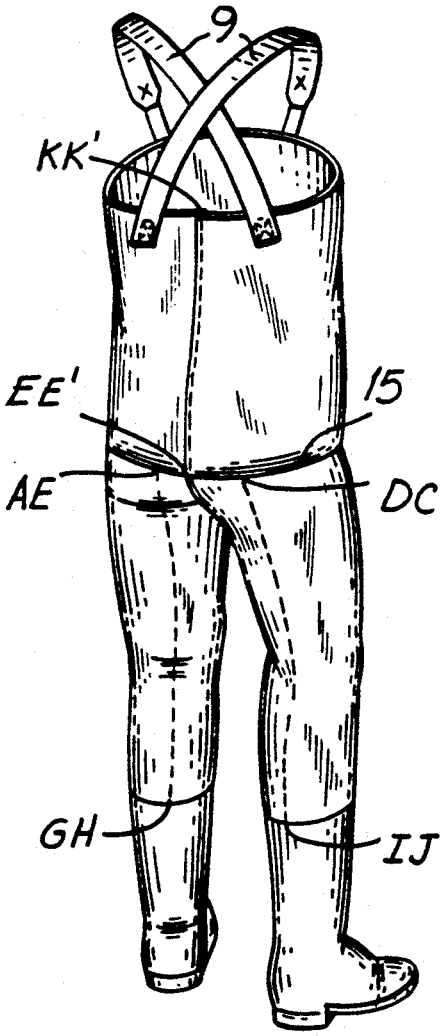
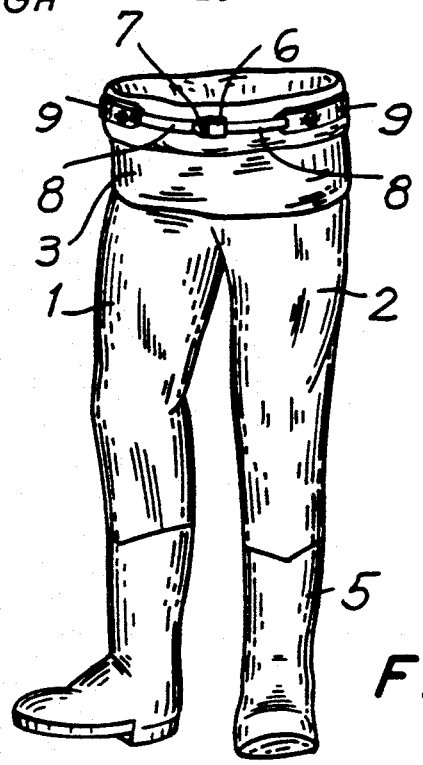
FIG. 6

PANTS TYPE GARMENT HAVING A SEAMLESS CROTCH

The present inventions relates to apparel, and more particularly to a pants type garment which eliminates the need for a seam in the crotch area.

BACKGROUND OF THE INVENTION

The presence of seams in the crotch area of athletic pants type garments has been a continuing problem. In the U.S. Pat. No. 4,261,060 to Zawacki it was noted that seams in the crotch and inner leg areas are the source or irritation and discomfort for athletics engaged in activities such as bicycling. In Zawacki a seamless panel provided in the crotch inner leg portion of the pants to overcome this problem.

A similar problem exists in waders used for hunting and fishing. In particular some waders are made of highly elastic neoprene and which are designed to snugly fit the body and be 100% waterproof. Neoprene waders are manufactured by butt gluing the seams and also by covering the seams with a waterproof tape. A problem of leakage often occurs in seams made in the crotch area because of the stress on such seams. By elimination of the seams in the crotch area the garment will not only be more comfortable but will, in the case of neoprene waders, be less likely to leak. The use of the inner panel by Zawacki does not eliminate the problem of stress on the seams that is particular to neoprene waders. The instant invention provides a pants type garment which does not utilize a seam in the crotch or inner leg area which tends to both irritate the wearers body and also be subject to increased stress.

SUMMARY OF INVENTION

Generally speaking, the present invention provides an improved pants type garment made of a stretchable material. The material is preferably an elastic or resilient material such as a foam. In the preferred embodiment the material is a closed cell neoprene foam material covered with a knit cloth material that adheres to the neoprene and is held in place across the entire surface on the neoprene. The material may be foam backed Nylon Tricot.

The invention provides a pants type garment which eliminates seams in the crotch area. This is done by having both legs of the garment formed from a substantially unitary piece of stretchable material. This unitary piece of the material is joined to the upper portion of the garment by a horizontal circular seam which is located in the vicinity of the crotch or hip instead of at the waist. The lower or leg portion of the garment has first and second recess cuts at the vicinity of the crotch and on opposite sides thereof. The lower portion is folded in half along a center fold. The legs are formed by the joining of the ends of the respective first and second recessed cuts.

Once the legs have been formed out of the lower portion, the upper portion of the garment is attached along a seam around the circumference of the two leg portions. This seam is located below the waist and at the vicinity of the point where the legs meet the upper body. It is preferable that the upper portion also be comprised of the same highly stretchable material in order to compensate for the variations in dimensions of the hips from the waist.

Accordingly, it is an object of the invention to provide an improved pants type garment which eliminates stress bearing seams in the crotch area.

It is a further object of the invention to provide an improved waterproof wader with a minimal amount of seams, thereby requiring less labor to manufacture.

Another object of the invention is to provide a waterproof wader which allows for better stretch and leg action.

Yet another object of the invention is to provide a more comfortable, long lasting waterproof wader.

Still another object of the invention is to provide an improved waterproof wader which has a torso portion cut from a pattern which is completely separate from the leg portion, thereby allowing for more flexibility of design of the torso portion.

Another object of the invention is to provide a pants type garment in which both legs and the crotch are cut from a unitary piece of material.

Still other objects and advantages of the invention will in part be obvious and will be apparent from the specification. The invention accordingly comprises the several steps and the relation of one or more of such steps with respect to each of the others, and the pants type garment possessing the features, properties and relation of elements, which are exemplified in the following detailed disclosure, and the scope of the invention will be indicated in the claims.

BRIEF DESCRIPTION OF THE DRAWINGS

For a fuller understanding of the invention, reference is made to the following description taken in connection with the accompanying drawings, in which:

FIG. 1 is a perspective front view of the wader;

FIG. 2 is a flat laid out view of the pattern from which the leg portion is made;

FIG. 3 is a flat laid out view of the pattern from which the torso portion is made;

FIG. 4 is a perspective view of the leg portion;

FIG. 5 is a back perspective view of the wader;

FIG. 6 is a front perspective view of the wader with the upper portion rolled down to the waist.

DESCRIPTION OF THE PREFERRED EMBODIMENTS

In FIG. 1 the entire wader is shown. The wader comprises a lower portion which is made from the pattern of FIG. 2. FIG. 4 shows the legs of the lower portion made from the pattern of FIG. 2. The lower portion includes left leg 2 and right leg 1. Feet 5 are connected to the ends of the legs and may be either a waterproof shoe or may be made of the same material from which the wader is made.

The wader is provided with an optional front pocket 17 and adjustable harness straps 8 attached to harness base straps 9. The adjustable harness straps are connected to the upper portion of the wader by an adjustable buckle 6 which has a male part 7 and a female part 6. It can be seen that on one of the adjustable straps 8 the male portion 7 is attached and on the other of the adjustable straps 8 the female portion 6 is attached thereto. Similarly the upper portion 3 of the wader has attached thereto straps to which the corresponding male and female portions of the buckles will accommodate the ends of the respective adjustable straps 8.

The leg portion of the garment is manufactured from the pattern of FIG. 2 in which the left leg section 2 is separated from the leg section 1 by centerfold 4. The pattern contains a first recessed cut which begins at point A on a first edge of the pattern (GABCI) and continues to point B at the end of the centerfold, and then continues back to point C also on the first edge of the pattern. Similarly, a second recess cut is formed beginning at point F on a second and opposite edge of the pattern (HFEDJ) and continuing to point E at the other end of the centerfold, and then continuing back to point D also on the second edge of the pattern.

In order to actually form the leg portion from the pattern of FIG. 2 points A and F, D and C, G and H, and I and J are joined. Thus left leg seam is formed along line AF-GH as shown in FIG. 4. Similarly right leg seam is formed along line DC-JI.

The upper torso portion 3 is made from a the pattern shown in FIG. 3. The upper portion is joined to the leg portion by aligning points E, AF, B, DC and E' on the corresponding points of the leg portion of FIG. 4. It can be seen that horizontal seam 15 results from the joining of the upper and lower portions of the wader and that seam 15 is located at the portion where the upper leg meets the upper body which is basically the hip of the garment.

In FIG. 5 the back of the garment is shown. The left leg seam AE-GH and right leg seam DC-JI, as well as the upper portion seam EE'-KK' are shown. All seams are butt glued and also utilize a waterproof tape 18 (shown only on left leg in FIG. 4 on the outside of the seam) which covers the seams on both the inside and outside of the garment. It has been found that the ratio of the length of centerfold B-E to the circumference of the thigh which is measured by the line ABEF for the left leg and line CBED for the right leg should be relatively constant in order to maintain a good comprise between a snug and loose fit. This ratio is critical to the fit desired. The larger the ratio, the larger the thighs are in relationship to the hips. The smaller the ratio, the smaller the thighs are in relationship to the hips. For the standard sizes of neoprene waders the ratio ranges between 0.304 to 1 and 0.259 to 1 and is preferably 0.28 to 1. The ratio might be varied considerably for non-standard custom sizes and might also vary for garments using a material other than elastic fabric backed neoprene or where a different fit and used is desired.

Another variable in the pattern is the width of the recessed cuts. To a degree, the wider they are the more freely the legs can move. The narrower they are the less freely the legs can move. This will vary according to the material, fit and function of the intended garment. This width should be constant through all sizes. On neoprene waders it tapers from 0" to 4.16" but is preferably about 2.5". With a more elastic material such as Spandex, it might be as little as 0.75".

The leg portion made from a substantially unitary stretchable piece of material which is symmetric about fold B,E. The upper portion is also made preferably from a similar stretchable material.

In the invention the connecting point between the torso and the leg portion of the wader is made at the crotch or hip level as opposed to at the waist level. As a result of the seamless crotch, the garment can accommodate most extreme leg movements so that walking and wading are relatively unrestricted. The torso portion may be extended to reach the upper chest level. As shown in FIG. 6 the torso portion may also be rolled down to the waist and secured with the two shoulder harnesses which now become a wader belt. It can thus be seen that the shoulder harnesses are used as suspenders when the wader is fully extended and covers the upper torso. When the wader is in a rolled down position the two shoulder harnesses can be converted into a belt since the ends of each harnesses can be crossed in the back and then connected to each other. It can be seen that either a unitary waterproof boot 5 or neoprene sock are attached to the lower legs.

It should thus be seen that the objects set forth above among those made apparent from the preceding description are efficiently attained and, certain changes may be made in the above garment without departing from the spirit and scope of the invention. It is intended that all matter contained in the above description shall be interpreted as illustrative and not in a limiting sense.

It is also to be understood that the following claims are intended to cover all of the generic and specific features of the invention herein described and all statements of the scope of the invention which, as a matter of language, might be said to fall there between.

What is claimed is:

1. A pants type garment comprising:

a leg portion made from a substantially unitary stretchable piece of material which is symmetric about a center fold;

an upper portion made from a stretchable material;

wherein, prior to being formed into the leg portion, said unitary piece of material defining a pattern containing a first recessed cut and a second recessed cut;

said first recessed cut beginning at a first point on a first edge of the pattern for said leg portion, said point being on the left side of said center fold and in the vicinity of the crotch area of said leg portion, and continuing to a furthest inset point which is located at a first end of the center fold thereby defining a first side of said first recessed cut, and then going back toward said first edge to a second point on said first edge which is on the right side of said center fold and thereby defining a second side of said first recessed cut;

said second recessed cut beginning at a third point which is located on a second edge opposite the first edge of the pattern for said leg portion, said third point being on the left side of said center fold and in the vicinity of the crotch area of said leg portion, and continuing to a furthest inset point which is located at the opposite end of the center fold thereby defining a first side of said second recessed cut, and then going back toward said second edge to a fourth point which is located on said second edge which is on the right side of said center fold and thereby defining a second side of said second recessed cut;

said center fold being at the crotch of the pants type garment and beginning at about the furthest inset point of said first recessed cut and continuing to the furthest inset point of said second cut;

said upper portion being attached to said leg portion by a seam along the first and second sides of the first recessed cut and the first and second sides of the second recessed cut.

2. The pants type garment of claim 1 wherein the stretchable material is a closed cell neoprene foam covered with a knit cloth material.

3. The pants type garment of claim 2 wherein the knit cloth material is Nylon Tricot.

4. The pants type garment of claim 1 wherein the seams are butt glued and are also covered with a waterproof tape.

5. The pants type garment of claim 1 further comprising a first ans second harness strap, said harness straps being fixed to the upper portion at one end and having connecting means at the other end, the connecting means of the first harness strap being adapted to be connected to either the connecting means of the second harness strap or to a third connecting means attached to the upper portion.

6. A pants type garment of claim 1 wherein the ratio of the length of the centerfold to the circumference of the thigh is from 0.304 to 1 and 0.259 to 1.

7. The pants type garment of claim 6 wherein the ratio is about 0.28 to 1.

8. The pants type garment of claim 1 wherein the first and second recessed cut are from 0.75" to 4" width.

9. The pants type garment of claim 8 wherein said recessed cuts are about 2.5" in width.

* * * * *